US010266918B2

(12) United States Patent
Sakai et al.

(10) Patent No.: US 10,266,918 B2
(45) Date of Patent: Apr. 23, 2019

(54) NI-BASED ALLOY EXCELLENT IN HOT FORGEABILITY, HIGH-TEMPERATURE OXIDATION RESISTANCE, AND HIGH-TEMPERATURE HALOGEN GAS CORROSION RESISTANCE, AND MEMBER MADE OF THE SAME

(71) Applicant: Hitachi Metals, Ltd., Tokyo (JP)

(72) Inventors: Hirokazu Sakai, Okegawa (JP); Katsuo Sugahara, Okegawa (JP)

(73) Assignee: Hitachi Metals, Ltd., Tokyo (JP)

( * ) Notice: Subject to any disclaimer, the term of this patent is extended or adjusted under 35 U.S.C. 154(b) by 234 days.

(21) Appl. No.: 14/914,201

(22) PCT Filed: Mar. 31, 2014

(86) PCT No.: PCT/JP2014/059406
§ 371 (c)(1),
(2) Date: Feb. 24, 2016

(87) PCT Pub. No.: WO2015/029484
PCT Pub. Date: Mar. 5, 2015

(65) Prior Publication Data

US 2016/0215367 A1 Jul. 28, 2016

(30) Foreign Application Priority Data

Aug. 27, 2013 (JP) ..... 2013-175389
Aug. 27, 2013 (JP) ..... 2013-175390

(51) Int. Cl.
*C22C 19/03* (2006.01)
*C22C 19/05* (2006.01)
*C22C 19/00* (2006.01)

(52) U.S. Cl.
CPC ..... *C22C 19/03* (2013.01); *C22C 19/007* (2013.01); *C22C 19/05* (2013.01)

(58) Field of Classification Search
CPC ..... C22C 19/03
See application file for complete search history.

(56) References Cited

U.S. PATENT DOCUMENTS 4,019,900 A 4/1977 Raghavan et al.
6,458,318 B1 * 10/2002 Nishiyama ..... C22C 19/055 148/428
2003/0170139 A1 * 9/2003 Mitsuhashi ..... C22C 19/03 420/445
2004/0187973 A1 9/2004 Takahata et al.

FOREIGN PATENT DOCUMENTS

CN 1570171 1/2005
JP 52-120221 10/1977
JP S6396235 A 4/1988
JP H02163336 A 6/1990
JP H0617170 A 1/1994
JP H0853729 A 2/1996
JP 2003262491 A 9/2003
JP 2012219369 A 11/2012

OTHER PUBLICATIONS

International Search Report, PCT/JP2014/059406, dated Jun. 10, 2014, 1 page.
Office Action corresponding to Chinese Application No. 201480058958.4 dated Dec. 15, 2016.

* cited by examiner

*Primary Examiner* — Christopher S Kessler
(74) *Attorney, Agent, or Firm* — Myers Bigel, P.A.

(57) ABSTRACT

There is provided a Ni-based alloy excellent in hot forgeability, high-temperature oxidation resistance, and high-temperature halogen gas corrosion resistance that is suitable as constituent materials, such as a baking tray for chip capacitor, a baking tray for lithium battery cathode material, a CVD apparatus member, a PVD apparatus member, an LCD apparatus member, and a semiconductor manufacturing apparatus member. The Ni-based alloy contains, by weight, 2.0 to 5.0% Al, 0.1 to 2.5% Si, 0.1 to 1.5% Mn, 0.001 to 0.01% B, 0.001 to 0.1% of Zr, and the balance of Ni with inevitable impurities and excels in hot forgeability, high-temperature oxidation resistance, and high-temperature halogen gas corrosion resistance. The Ni-based alloy may further contain 0.8 to 4.0% Cr.

6 Claims, No Drawings

NI-BASED ALLOY EXCELLENT IN HOT FORGEABILITY, HIGH-TEMPERATURE OXIDATION RESISTANCE, AND HIGH-TEMPERATURE HALOGEN GAS CORROSION RESISTANCE, AND MEMBER MADE OF THE SAME

RELATED APPLICATIONS

This application is a 35 U.S.C. § 371 national phase application of PCT Application PCT/JP2014/059406 filed Mar. 31, 2014, which claims priority to Japanese Application Nos. 2013-175389 filed Aug. 27, 2013, and 2013-175390 filed Aug. 27, 2013, the contents of which are incorporated herein by reference in their entireties.

TECHNICAL FIELD

The present invention relates to a Ni-based alloy excellent in hot forgeability, high-temperature oxidation resistance, and high-temperature halogen gas corrosion resistance, and to a member made of the Ni-based alloy, especially, a baking tray for chip capacitor, a baking tray for lithium battery cathode material, a CVD apparatus member, a PVD apparatus member, an LCD apparatus member, and a semiconductor manufacturing apparatus member.

The present application claims priorities from Japanese Patent Application No. 2013-175389 and Japanese Patent Application No. 2013-1175390 filed on Aug. 27, 2013, which are incorporated herein by reference in their entirety.

BACKGROUND ART

In general, a member such as a tray used in an oxidization furnace or baking furnace has been made of a Ni-based alloy with superior high-temperature oxidation resistance, in order to prevent oxidation scale generated from the member from entering into a product.

As such a Ni-based alloy that is superior in high-temperature oxidation resistance, for example, Patent Document 1 discloses a Ni-based alloy excellent in high-temperature oxidation resistance that contains 3.6 to 4.4% by mass (hereinafter, "%" indicates % by mass) of Al, optionally one or more elements selected from 0.1 to 2.5% of Si, 0.8 to 4.0% of Cr, and 0.1 to 1.5% of Mn, and the balance of Ni with inevitable impurities and that is used as a fin and a tube for a high-temperature heat exchanger.

In addition, Patent Document 2 discloses a Ni-based alloy that contains 0.05 to 2.5% of Al, 0.3 to 2.5% of Si, 0.5 to 3.0% of Cr, and 0.5 to 1.8% of Mn with a Si/Cr ratio specified to be less than or equal to 1.1 and the balance of Ni with inevitable impurities and that excels in both heat resistance and corrosion resistance.

Furthermore, Patent Document 3 discloses a Ni-based alloy for spark plug electrode material that contains 3.1 to 4.3% of Al, 0.05 to 1.5% of Si, 1 to 2% of Cr, 0.45 to 0.65% of Mn, 0.005 to 0.05% of one or more elements of Mg and Ca, and the balance of Ni with inevitable impurities and that excels in both high-temperature strength and spark consumption resistance.

Moreover, for the CVD apparatus member, the PVD apparatus member, the LCD apparatus member, and the semiconductor manufacturing apparatus member, pure Ni or a Ni-based alloy member on the surface of which a Ni—Al layer that is superior in both plasma reactive resistance and corrosion resistance against halogen-based gas in the processes such as film formation and cleaning is formed is used.

As such a member that is superior in high-temperature halogen gas corrosion resistance, for example, there is proposed a member for a film formation processing apparatus such that a material of its base material is either pure Ni or a Ni—Cr—Fe alloy on the surface of which a Ni—Al alloy layer is formed, as shown in Patent Document 4.

CITATION LIST

Patent Document

[Patent Document 1] JP 3814822 B
[Patent Document 2] JP H2-163336 A
[Patent Document 3] JP 3206119 B
[Patent Document 4] JP 2012-219369 A

SUMMARY OF INVENTION

Technical Problem

In recent years, in applications of jigs for manufacturing semiconductor products etc., jig members that excel in high-temperature oxidation resistance and are large are required. However, since it cannot be said that the Ni-based alloys disclosed in Patent Documents 1 to 3 mentioned above are sufficient in hot forgeability or high-temperature oxidation resistance, they did not have satisfactory characteristics as a Ni-based alloy for applications that required the hot forgeability and the high-temperature oxidation resistance. Furthermore, in applications of semiconductor manufacturing apparatus members etc., further corrosion resistance against halogen gases has come to be required for portions and moving parts where high dimensional accuracy is required. However, since a member for a film formation processing apparatus disclosed in Patent Document 4 mentioned above is subjected to machining on its base material and subsequent film formation processing, it is difficult to achieve high dimensional accuracy, and in a movable part the film is broken in a microscopic manner, which becomes a source of generating particles; therefore, the member was not one that had satisfactory characteristics for these portions.

Solution to Problem

In view of this, the present inventors have carried out research earnestly in order to develop a Ni-based alloy that solves such problems, has more superior hot forgeability than a conventional one, and at the same time has superior high-temperature oxidation resistance and high-temperature halogen gas corrosion resistance, and consequently, the inventors have obtained a research result that by incorporating 0.001 to 0.01% of B and 0.001 to 0.1% of Zr in a Ni-based alloy of which the composition is as disclosed in Patent Document 1 mentioned above, i.e., containing, by weight, 2.0 to 5.0% of Al, 0.1 to 2.5% of Si, and 0.1 to 1.5% of Mn, this Ni-based alloy not only exhibits high-temperature oxidation resistance equivalent to that of the Ni-based alloy disclosed in Patent Document 1 mentioned above, but also has further excellent hot forgeability and at the same time exhibits excellent corrosion resistance even against high-temperature halogen gases.

Furthermore, the inventors have obtained a research result that by incorporating 0.001 to 0.01% of B and 0.001 to 0.1% of Zr in a Ni-based alloy of a component composition as disclosed in Patent Document 1 mentioned above that contains, by weight, 2.0 to 5.0% of Al, 0.1 to 2.5% of Si, 0.8 to 4.0% of Cr, and 0.1 to 1.5% of Mn and the balance of Ni with inevitable impurities, this Ni-based alloy not only exhibits the high-temperature oxidation resistance equivalent to that of the Ni-based alloy disclosed in Patent Document 1 mentioned above, but also has further excellent hot forgeability and also exhibits excellent corrosion resistance to high-temperature halogen gases.

The present invention has been made by the findings mentioned above and has the following aspects.

(1) A Ni-based alloy excellent in hot forgeability, high-temperature oxidation resistance, and high-temperature halogen gas corrosion resistance, the Ni-based alloy having a composition consisting of, by weight, 2.0 to 5.0% Al,
0.1 to 2.5% Si,
0.1 to 1.5% Mn,
0.001 to 0.01% B,
0.001 to 0.1% Zr, and
the balance of Ni with inevitable impurities.

(2) A Ni-based alloy excellent in hot forgeability, high-temperature oxidation resistance, and high-temperature halogen gas corrosion resistance according to (1) mentioned above, the Ni-based alloy having a composition consisting of, by weight, 3.6 to 4.2% Al,
1.1 to 1.7% Si,
0.2 to 0.7% Mn,
0.001 to 0.007% B,
0.001 to 0.06% Zr, and
the balance of Ni with inevitable impurities.

(3) A baking tray for chip capacitor or lithium battery cathode material, a CVD apparatus member, a PVD apparatus member, an LCD apparatus member, and a semiconductor manufacturing apparatus member that are made of the Ni-based alloy according to (1) or (2) mentioned above.

(4) A Ni-based alloy excellent in hot forgeability, high-temperature oxidation resistance, and high-temperature halogen gas corrosion resistance, the Ni-based alloy having a composition consisting of, by weight, 2.0 to 5.0% Al,
0.1 to 2.5% Si,
0.8 to 4.0% Cr,
0.1 to 1.5% Mn,
0.001 to 0.01% B,
0.001 to 0.1% Zr, and
the balance of Ni with inevitable impurities.

(5) A Ni-based alloy excellent in hot forgeability, high-temperature oxidation resistance, and high-temperature halogen gas corrosion resistance according to (4) mentioned above, the Ni-based alloy having a composition consisting of, by weight, 3.6 to 4.2% Al,
1.1 to 1.7% Si,
1.6 to 2.3% Cr,
0.2 to 0.7% Mn,
0.001 to 0.007% B,
0.001 to 0.06% Zr, and
the balance of Ni with inevitable impurities.

(6) A baking tray for chip capacitor or lithium battery cathode material, a CVD apparatus member, a PVD apparatus member, an LCD apparatus member, and a semiconductor manufacturing apparatus member that are made of the Ni-based alloy according to (4) or (5) mentioned above.

Next, with respect to the Ni-based alloy of the present invention, the reasons for the content ranges of each component element in the alloy composition will be described in detail.

Al

Al is added because it has actions of improving the high-temperature oxidation resistance and reducing occurrence of oxidation scale by forming an aluminum film on the surface of the Ni-based alloy and also has an action of reducing generation of particles by forming aluminum fluoride having high protection, especially in a high-temperature fluorine-based gas environment and decreasing generation of corrosion products. However, when its content is less than 2.0%, the desired effect is not attained because neither sufficient alumina film nor aluminum fluoride film is formed, whereas when the content is more than 5.0%, the hot processability reduces by γ' phase ($Ni_3Al$ intermetallic compound) precipitating in its base material, and it becomes difficult to process it; therefore such contents are undesirable. Accordingly, the content of Al is set to be 2.0 to 5.0%. A more preferable content of Al is 3.6 to 4.2%.

Si

Si is added because it has an action of improving the high-temperature oxidation resistance. However, when the content is less than 0.1%, a desired improvement effect cannot be obtained in the action, whereas when the content is more than 2.5%, the alloy easily cracks at the time of hot processing; therefore, the content is set to be 0.1 to 2.5%. A more preferable content of Si is 1.1 to 1.7%.

Cr

Cr is added as necessary because it has an action of improving heat resistance. However, when its content is less than 0.8%, a desired improvement effect cannot be obtained in the action, whereas when the content is more than 4.0%, the high-temperature strength shows a tendency to deteriorate; therefore, the content is set to be 0.8 to 4.0%. A more preferable content of Cr is 1.6 to 2.3%.

Mn

Mn is added because it has an action of improving high-temperature strength. However, when its content is less than 0.1%, a desired improvement effect cannot be obtained in the action, whereas when the content is more than 1.5%, the high-temperature oxidation resistance deteriorates; therefore, the content is set to be 0.1 to 1.5%. A more preferable content of Mn is 0.2 to 0.7%.

B and Zr

B and Zr have an action of improving the hot forgeability of the Ni-based alloy by being added to the alloy in coexistence.

In the case of the respective contents of B and Zr, when the content of B is less than 0.001%, a desired improvement effect cannot be obtained in the action, whereas when the content of B is more than 0.01%, the hot forgeability is undesirably reduced; therefore, the content of B is set to be 0.001 to 0.01%. A more preferable content of B is 0.001 to 0.007%.

In addition, although Zr also improves the hot forgeability of the Ni-based alloy, when the content of Zr is less than 0.001%, a desired effect cannot be obtained in the improvement of the hot forgeability, whereas when the content is more than 0.1%, the hot forgeability is undesirably reduced as in the case of B addition; therefore, the content of Zr is set to be 0.001 to 0.1%. A more preferable content of Zr is 0.001 to 0.06%.

In the present invention, although both of B and Zr are added and incorporated in the alloy simultaneously within a range of 0.001 to 0.01% and 0.001 to 0.1%, respectively (preferably, 0.001 to 0.007% and 0.001 to 0.06%, respectively). However, in the case of adding either one of them, or in the case in which either one of them is added in a quantity outside the range of the present invention, an improvement effect of the hot forgeability cannot be expected. It is presumed that this is because since simultaneous addition of B and Zr strengthens the grain boundary of the Ni-based alloy, generation of intergranular failure in the hot forging is inhibited.

Since the Ni-based alloy of the present invention made of the above-mentioned alloy component composition excels in high-temperature oxidation resistance and high-temperature halogen gas corrosion resistance and has superior hot forgeability, suitably, it can be used as constitutional members such as: a baking tray for chip capacitor, a baking tray for lithium battery cathode material, a CVD apparatus member, a PVD apparatus member, a LCD apparatus member, and a semiconductor manufacturing apparatus member.

Furthermore, the Ni-based alloy of the present invention can be naturally used, in addition to what are men in led above, in various applications that require the high-temperature oxidation resistance and the hot forgeability, such as a member for an oxidation furnace, a member for a baking furnace, a muffler in a silver-tin baking process, a jig for processes for fabricating hard metals, and a retort for a baking process of special powder (LED raw material etc.) etc. among plates, tube materials, wire materials, cast steels, forged steels of the Ni-based alloy, and jigs and members formed therefrom by processing.

Advantageous Effects of Invention

As described above, since the Ni-based alloy of the present invention has extremely superior hot forgeability, high-temperature oxidation resistance, and high-temperature halogen gas corrosion resistance, a baking tray for chip capacitor and a baking tray for lithium battery cathode material made of the Ni-based alloy of the present invention undergo little generation of oxidation scale, require less maintenance, last long, and can achieve reduction in cost. In addition, since the CVD apparatus member, the PVD apparatus member, the LCD apparatus member, and the semiconductor manufacturing apparatus member made of the Ni-based alloy of the present invention inhibit generation of particles by corrosion even in a process environment containing halogen gas, they contribute to improvement in the yield of semiconductors and FPDs that are products, and demonstrate excellent industrial effects.

DESCRIPTION OF EMBODIMENTS

Hereinafter, examples according to the present invention will be described.

EXAMPLES

Example 1

Raw materials were mixed at predetermined ratio, were vacuum melted and vacuum cast in a melting furnace, and were formed into ingots made of Ni-based alloys 1 to 10 of the present invention that have alloy component compositions shown in Table 1 and have a diameter of 300 mm in size.

Next, this ingot was subjected to hot forging in a state of being heated to a temperature of 1200° C. and was produced into a plate having a thickness of 25 mm and a width of 300 mm.

This plate being hot forged was further hot-rolled at a temperature of 1200° C., and was processed into a hot rolled sheet having a width of 300 mm. Further, this hot rolled sheet was subjected to heat processing of quenching from 900° C., was subsequently stripped of oxidation scale on the surface, and was produced into a 3 mm thick plate eventually.

For comparison, raw materials were mixed with a predetermined ratio, and these materials were vacuum melted and vacuum cast in a high-frequency meting furnace to be produced into ingots made of Comparison Ni-based alloys 1 to 10 and Conventional Ni-based alloy 1 that have alloy component compositions shown in Tables 2 and 3 and have a diameter of 300 mm.

Incidentally, Conventional Ni-based alloy 1 shown in Table 3 is a Ni-based alloy having an alloy component composition disclosed in Patent Document 1 mentioned above. Furthermore, Conventional Ni-based alloy 2 shown in Table 3 is a so-called 600 alloy (UNS N06600) that has a chemical composition containing, by weight, 15.5% Cr and 9% Fe, and the balance of Ni with inevitable impurities and has been successfully much used in semiconductor manufacturing apparatuses or the like.

The ingots made of Comparison N-based alloys 1 to 10 and Conventional Ni-based alloy 1 mentioned above were subjected to the hot forging, the hot rolling, the heat processing, and the oxidation scale removal processing, which were the same as those for Ni-based alloys 1 to 11 of the present invention. Conventional Ni-based alloy 2 was commercially purchased as a 3 mm thick plate.

As regards the Ni-based alloy that generated a crack during the hot forging, "crack generation during hot forging" is shown in Tables 2 and 3.

Next, on ones that were produced into the 3 mm thick plate without generating cracks during the hot forging among Ni-based alloys 1 to 11 of the present invention, Comparison Ni-based alloys 1 to 10, and Conventional Ni-based alloy 1, an evaluation test for high-temperature oxidation resistance was conducted, as well as Conventional Ni-based alloy 2, as follows.

First, corrosion test pieces of 50×25×3 mm were produced from the 3 mm thick plates produced above, respectively. Next, the surfaces of these test pieces were polished and finished eventually with waterproof emery paper #400. Next, they were held in acetone in an ultrasonic vibration state for five minutes to be degreased. Next, on each of the corrosion test pieces that were made of Ni-based alloys 1 to 11 of the present invention, Comparison Ni-based alloys 1-10, and Conventional Ni-based alloys 1 and 2 mentioned above, an exposure test of 750° C.×30 hours was conducted 10 times repeatedly, and the thicknesses of the oxide films were measured by observing cross sections of the corrosion test pieces after the test with an optical microscope.

Furthermore, each of the test pieces that were made of Ni-based alloys 1 to 11 of the present invention, Comparison Ni-based alloys 1 to 10, and Conventional Ni-based alloys 1 and 2 mentioned above formed separately by the same method was attached near a gas exhaust port in a plasma CVD chamber, and particle quantities when being exposed to high-temperature fluorine-based gas were compared. The test conditions are as follows. Chamber internal pressure: 5 Torr, Cleaning gas: $C_2F_6$, and a high-frequency electric power of 750 W was applied between electrodes to generate plasma for 60 seconds. The number of particles was measured by a particle counter attached to the gas exhaust port near the test piece. At this time, the chamber inner temperature was maintained at 500° C. In the evaluation, the numbers were compared assuming that the number of Conventional Ni-based alloy 2 is 100%, The test results are shown in Tables 1 to 3.

TABLE 1

| Ni-based alloys of the present invention (unit: weight %) | | | | | | | | |
|---|---|---|---|---|---|---|---|---|
| | Composition | | | | | | Evaluation of high-temperature oxidation resistance | High-temperature halogen gas corrosion resistance |
| | Al | Si | Mn | B | Zr | Ni + inevitable impurities | Oxide film thickness (μm) | Particle generation rate(note) |
| 1 | 2.1 | 1.2 | 0.4 | 0.007 | 0.012 | balance | 6 | 15 |
| 2 | 4.9 | 1.4 | 0.7 | 0.005 | 0.060 | balance | 4 | 4 |
| 3 | 3.9 | 0.1 | 0.2 | 0.006 | 0.055 | balance | 5 | 6 |
| 4 | 4.0 | 2.5 | 0.5 | 0.003 | 0.041 | balance | 5 | 4 |
| 5 | 4.1 | 1.5 | 0.1 | 0.002 | 0.038 | balance | 4 | 4 |
| 6 | 4.2 | 1.7 | 1.5 | 0.003 | 0.031 | balance | 5 | 4 |
| 7 | 3.9 | 1.6 | 0.6 | 0.001 | 0.025 | balance | 5 | 5 |

TABLE 1-continued

| Ni-based alloys of the present invention (unit: weight %) | | | | | | | | |
|---|---|---|---|---|---|---|---|---|
| | Composition | | | | | | Evaluation of high-temperature oxidation resistance | High-temperature halogen gas corrosion resistance |
| | Al | Si | Mn | B | Zr | Ni + inevitable impurities | Oxide film thickness (μm) | Particle generation rate(note) |
| 8 | 4.0 | 1.4 | 0.4 | 0.009 | 0.028 | balance | 4 | 6 |
| 9 | 3.8 | 1.4 | 0.5 | 0.004 | 0.001 | balance | 5 | 7 |
| 10 | 3.9 | 1.3 | 0.6 | 0.005 | 0.099 | balance | 5 | 6 |
| 11 | 4.0 | 1.4 | 0.5 | 0.004 | 0.032 | balance | 4 | 5 |

(note)"Particle generation rate" indicates a relative rate on the assumption that a value of the conventional Ni-based alloy in Table 3 is 100.

TABLE 2

| Comparison Ni-based alloys (unit: weight %) | | | | | | | | |
|---|---|---|---|---|---|---|---|---|
| | Composition | | | | | | Evaluation of high-temperature oxidation resistance | High-temperature halogen gas corrosion resistance |
| | Al | Si | Mn | B | Zr | Ni + inevitable impurities | Oxide film thickness (μm) | Particle generation rate(note) |
| 1 | 1.8* | 1.4 | 0.3 | 0.007 | 0.055 | balance | 8 | 21 |
| 2 | 5.2* | 1.3 | 0.3 | 0.003 | 0.049 | balance | Crack generation during hot forging | |
| 3 | 3.8 | 0.07* | 0.2 | 0.005 | 0.037 | balance | 7 | 15 |
| 4 | 3.9 | 2.7* | 0.4 | 0.006 | 0.041 | balance | Crack generation during hot forging | |
| 5 | 4.0 | 1.1 | 0.07* | 0.004 | 0.053 | balance | Fine crack confirmed after hot forging | |
| 6 | 3.9 | 1.2 | 1.8* | 0.005 | 0.048 | balance | 5 | 55 |
| 7 | 4.1 | 1.5 | 0.5 | —* | 0.040 | balance | Crack generation during hot forging | |
| 8 | 3.9 | 1.4 | 0.4 | 0.015* | 0.052 | balance | Crack generation during hot forging | |
| 9 | 3.7 | 1.3 | 0.6 | 0.004 | —* | balance | Crack generation during hot forging | |
| 10 | 3.6 | 1.4 | 0.5 | 0.003 | 0.115* | balance | Crack generation during hot forging | |

(Note)

Symbol * indicates out of the range of the composition of the present invention.

(note)"Particle generation rate" indicates a relative rate on the assumption that a value of the conventional Ni-based alloys in Table 3 is 100.

TABLE 3

| Conventional Ni-based alloys (unit: weight %) | | | | | | | | | |
|---|---|---|---|---|---|---|---|---|---|
| | Composition | | | | | | | Evaluation of high-temperature oxidation resistance | High-temperature halogen gas corrosion resistance |
| | Al | Si | Cr | Mn | B | Zr | Ni + inevitable impurities | Oxide film thickness (μm) | Particle generation rate(note) |
| 1 | 4.2 | 1.5 | 1.9 | 0.5 | — | — | balance | Crack generation during hot forging | Crack generation during hot forging |

TABLE 3-continued

| Conventional Ni-based alloys (unit: weight %) | | | | | | | | | |
|---|---|---|---|---|---|---|---|---|---|
| | Composition | | | | | | | Evaluation of high-temperature oxidation resistance | High-temperature halogen gas corrosion resistance |
| | Al | Si | Cr | Mn | B | Zr | Ni + inevitable impurities | Oxide film thickness (μm) | Particle generation rate(note) |
| 2 | 0.1 | 0.1 | 15.5 | 0.4 | — | — | 9% Fe, and balance | 40 | 100 |

(note)"Particle generation rate" indicates a relative rate on the assumption that a value of the conventional Ni-based alloys in Table 3 is 100.

In view of the results shown in Tables 1 and 2, regarding Comparison Ni-based alloys 1 to 10 having alloy component compositions deviating from the present invention, cracks were generated on Comparison Ni-based alloys 2, 4, and 7 to 10 during hot forging, and thus, the evaluations test for high-temperature oxidation resistance and for high-temperature halogen gas corrosion resistance thereof could not be carried out. Similarly, fine cracks were confirmed on Comparison Ni-based alloy 5 after the hot forging, and thus, the evaluation tests for high-temperature oxidation resistance and for high-temperature halogen gas corrosion resistance thereof could not be carried out.

In particular, Comparison Ni-based alloy 7 to which only Zr was added, Comparison Ni-based alloy 9 to which only B was added, and Comparison Ni-based alloys 8 and 10 in which either Zr or B was out of the range of the present invention were inferior in hot forgeability, because cracks were generated on each thereof during the hot forging.

In addition, Comparison Ni-based alloys 1 and 3 could be of forged, but were inferior in high-temperature oxidation resistance as compared with Ni-based alloys 1 to 11 of the present invention, because a thick oxide film was formed on each thereof. Also Comparison Ni-based alloy 6 could be hot forged, but was inferior in high-temperature halogen gas corrosion resistance as compared with Ni-based alloys 1 to 11 of the present invention, because the particle generation rate thereof was high.

Furthermore, it was found from the results shown in Tables 1 and 3 that Ni-based alloys 1 to 11 of the present invention were superior in hot forgeability as compared with Conventional Ni-based alloy 1 that is a conventional material. Conventional Ni-based alloy 1 did not reach the evaluation test for high-temperature oxidation resistance because cracks were generated during the hot forging. Also, it turned out that Ni-based alloys 1 to 11 of the present invention were superior in high-temperature halogen gas corrosion resistance as compared with Conventional Ni-based alloy 2 that is a conventional material.

It was found from the results of Tables 1 to 3 mentioned above that the Ni-based alloys of the present invention were superior in hot forgeability and were superior in high-temperature oxidation resistance and high-temperature halogen gas corrosion resistance, especially because alloy components B and Zr were simultaneously added in predetermined amounts, respectively.

Example 2

To produce ingots made of the Ni-based alloys of the present invention having the alloy component compositions shown in Table 1, raw materials were mixed with a predetermined ratio and then were vacuum melted and vacuum east in a high-frequency melting furnace to produce an ingot having a diameter of 300 mm in size. Next, these ingots underwent the hot forging in a state of being heated to a temperature of 1200° C. to produce plates each having a thickness of 25 mm and a width of 300 mm.

These plates resulting from the hot forging were hot-rolled at a temperature of 1200° C. to produce hot rolled sheets each having a width of 300 mm in size, and then, these hot rolled sheets were subjected to the heat processing of quenching from 900° C., subsequently was stripped of oxidation scale on the surface thereof to produce a 3 mm thick plate eventually.

For comparison, to produce ingots made of Comparison Ni-based alloys 11 to 22 and Conventional Ni-based alloy 3 having alloy component compositions shown in Tables 2 and 3, raw materials were mixed with a predetermined ratio and then were vacuum melted and vacuum cast in the high-frequency meting furnace to produce an ingot having a diameter of 300 mm.

Conventional Ni-based alloy 3 shown in Table 6 is the Ni-based alloy having an alloy component composition disclosed in Patent Document 1. Also, Conventional Ni-based alloy 4 shown in Table 6 is so-called alloy 600 (UNS N06600) that has a chemical composition of, by weight, 15.5% Cr, 9% Fe, and the balance of Ni with inevitable impurities and that has been successfully used much in semiconductor producing apparatus or the like.

The ingots made of Comparison Ni-based alloys 11 to 12 and Conventional Ni-based alloy 3 mentioned above were subjected to hot forging, hot rolling, heat processing, and oxidation scale removal processing, which were the same as those of Ni-based alloys 12 to 26 of the present invention. Conventional Ni-based alloy 4 was commercially purchased as a 3 mm thick plate.

As regards the Ni-based alloy that generated a crack during the hot forging, "crack generation during hot forging" is shown in Tables 5 and 6.

Next, on ones that were produced into the 3 mm thick plate without generating cracks during the hot forging among Ni-based alloys 12 to 26 of the present invention, Comparison Ni-based alloys 11 to 22, and Conventional Ni-based alloy 3, an evaluation test for high-temperature oxidation resistance was conducted, as well as Conventional Ni-based alloy 4, as follows.

First, corrosion test pieces of 50×25×3 mm were produced from the 3 mm thick plates produced above, respectively. Next, the surfaces of these test pieces were polished and finished eventually with waterproof emery paper #400.

Next, they were held in acetone in an ultrasonic vibration state for five minutes to be degreased. Next, on each of the corrosion test pieces that were made of Ni-based alloys 12 to 26 of the present invention, Comparison Ni-based alloys 11-22, and Conventional Ni-based alloys 3 and 4 mentioned above, an exposure test of 750° C.×30 hours was conducted 10 times repeatedly, and the thicknesses of the oxide films were measured by observing cross sections of the corrosion test pieces after the test with an optical microscope.

Furthermore, each of test pieces that were made of Ni-based alloys 12 to 26 of the present invention, Comparison Ni-based alloys 11 to 22, and Conventional Ni-based alloys 3 and 4 mentioned above formed separately by the same method was attached near a gas exhaust port in a plasma CVD chamber, and particle quantities when being exposed to high-temperature fluorine-based gas were compared. The test conditions are as follows. Chamber internal pressure: 5 Torr, Cleaning gas: $C_2F_6$, and a high-frequency electric power of 750 W was applied between electrodes to generate plasma for 60 seconds. The number of particles was measured by a particle counter attached to the gas exhaust port near the test piece. At this time, chamber inner temperature was maintained at 500° C. In the evaluation, the numbers were compared assuming that the number of Conventional Ni-based alloy 4 is 100%. The test results are shown in Tables 4 to 6.

TABLE 4

Ni-based alloys of the present invention (unit: weight %)

| | Composition | | | | | | | Evaluation of high-temperature oxidation resistance | High-temperature halogen gas corrosion resistance |
|---|---|---|---|---|---|---|---|---|---|
| | Al | Si | Cr | Mn | B | Zr | Ni + inevitable impurities | Oxide film thickness (μm) | Particle generation rate(note) |
| 12 | 2.1 | 1.5 | 1.9 | 0.5 | 0.003 | 0.012 | balance | 4 | 24 |
| 13 | 3.7 | 1.4 | 2.0 | 0.4 | 0.004 | 0.011 | balance | 1 | 25 |
| 14 | 5.0 | 2.1 | 2.2 | 0.4 | 0.004 | 0.035 | balance | 2 | 26 |
| 15 | 3.8 | 0.2 | 3.5 | 0.5 | 0.003 | 0.020 | balance | 4 | 33 |
| 16 | 4.0 | 2.4 | 1.8 | 1.1 | 0.003 | 0.064 | balance | 2 | 20 |
| 17 | 3.9 | 1.6 | 0.9 | 0.5 | 0.004 | 0.011 | balance | 3 | 11 |
| 18 | 4.0 | 1.3 | 3.8 | 0.8 | 0.004 | 0.015 | balance | 3 | 37 |
| 19 | 3.8 | 1.4 | 2.1 | 0.2 | 0.003 | 0.016 | balance | 2 | 22 |
| 20 | 3.9 | 0.5 | 1.2 | 1.4 | 0.003 | 0.041 | balance | 3 | 13 |
| 21 | 3.8 | 1.6 | 2.0 | 0.4 | 0.002 | 0.020 | balance | 2 | 23 |
| 22 | 4.0 | 0.9 | 1.8 | 0.5 | 0.009 | 0.013 | balance | 3 | 20 |
| 23 | 3.8 | 1.5 | 1.9 | 0.4 | 0.004 | 0.003 | balance | 2 | 23 |
| 24 | 3.9 | 1.6 | 1.9 | 0.4 | 0.004 | 0.097 | balance | 3 | 21 |
| 25 | 4.0 | 1.4 | 2.0 | 0.4 | 0.003 | 0.011 | balance | 1 | 23 |
| 26 | 3.8 | 1.5 | 2.0 | 0.5 | 0.005 | 0.047 | balance | 2 | 24 |

(note)"Particle generation rate" indicates a relative rate on the assumption that a value of the conventional Ni-based alloy in Table 6 is 100.

TABLE 5

Comparative Ni-based alloys (unit: weight %)

| | Al | Si | Cr | Mn | B | Zr | Ni + inevitable impurities | Evaluation of high-temperature oxidation resistance Oxide film thickness (μm) | High-temperature halogen gas corrosion resistance Particle generation rate(note) |
|---|---|---|---|---|---|---|---|---|---|
| 11 | 1.7* | 1.3 | 1.8 | 0.5 | 0.003 | 0.023 | balance | 8 | 54 |
| 12 | 5.3* | 1.4 | 1.8 | 0.4 | 0.004 | 0.015 | balance | Crack generation during hot forging | |
| 13 | 3.6 | 0.07* | 1.9 | 0.5 | 0.004 | 0.035 | balance | 6 | 48 |
| 14 | 3.9 | 2.7 | 1.8 | 0.4 | 0.002 | 0.019 | balance | Crack generation during hot forging | |
| 15 | 3.8 | 1.3 | 0.6* | 0.6 | 0.003 | 0.020 | balance | 5 | 29 |
| 16 | 3.6 | 1.4 | 4.3* | 0.4 | 0.006 | 0.012 | balance | 5 | 73 |
| 17 | 3.7 | 1.3 | 2.0 | 0.08* | 0.004 | 0.019 | balance | Fine crack confirmed after hot forging | |
| 18 | 3.6 | 1.2 | 2.0 | 1.8* | 0.007 | 0.021 | balance | 7 | 69 |
| 19 | 3.8 | 1.4 | 2.1 | 0.3 | —* | 0.014 | balance | Crack generation during hot forging | |
| 20 | 3.8 | 1.4 | 1.9 | 0.4 | 0.022* | 0.015 | balance | Crack generation during hot forging | |

TABLE 5-continued

| Comparative Ni-based alloys (unit: weight %) | | | | | | | | | |
|---|---|---|---|---|---|---|---|---|---|
| | Al | Si | Cr | Mn | B | Zr | Ni + inevitable impurities | Evaluation of high-temperature oxidation resistance Oxide film thickness (μm) | High-temperature halogen gas corrosion resistance Particle generation rate(note) |
| 21 | 3.9 | 1.3 | 2.0 | 0.3 | 0.005 | —* | balance | Crack generation during hot forging | |
| 22 | 3.9 | 1.5 | 2.1 | 0.4 | 0.003 | 0.118 | balance | Crack generation during hot forging | |

(Note)

Symbol * indicates the composition deviating from the present invention (note)"Particle generation rate" indicates a relative rate on the assumption that a value of the conventional Ni-based alloy in Table 6 is 100.

TABLE 6

| Conventional Ni-based alloys (unit: weight %) | | | | | | | | | |
|---|---|---|---|---|---|---|---|---|---|
| | Composition | | | | | | | Evaluation of high-temperature oxidation resistance | High-temperature halogen gas corrosion resistance |
| | Al | Si | Cr | Mn | B | Zr | Ni + inevitable impurities | Oxide film thickness (μm) | Particle generation rate(note) |
| 3 | 4.2 | 1.5 | 1.9 | 0.5 | — | — | balance | Crack generation during hot forging | Crack generation during hot forging |
| 4 | 0.1 | 0.1 | 15.5 | 0.4 | — | — | 9% Fe, and balance | 40 | 100 |

(note)"Particle generation rate" indicates a relative rate on the assumption that a value of the conventional Ni-based alloy in Table 6 is 100.

In view of the results shown in Tables 4 and 5, regarding Comparison Ni-based alloys 11 to 22 having alloy component compositions deviating from the present invention, cracks were generated on Comparison Ni-based alloys 12, 14, and 19 to 22 during the hot forging, and thus, the evaluation tests for high-temperature oxidation resistance and for high-temperature halogen gas corrosion resistance thereof could not be carried out. Similarly, fine cracks were confirmed on Comparison Ni-based alloy 17 after the hot forging, and thus, the evaluation tests for high-temperature oxidation resistance and for high-temperature halogen gas corrosion resistance thereof could not be carried out.

In particular, Comparison Ni-based alloy 19 to which only Zr was added, Comparison Ni-based alloy 21 to which only B was added, and Comparison Ni-based alloys 20 and 22 in which either Zr or B was out of the range of the present invention were inferior in hot forgeability, because the cracks were generated on each thereof during the hot forging.

In addition, Comparison Ni-based alloys 11 and 13 could be hot forged, but were inferior in high-temperature oxidation resistance as compared with Ni-based alloys 12 to 26 of the present invention, because a thick oxide film was formed on each thereof. Also. Comparison Ni-based alloys 15, 16 and 18 could be hot forged, but were inferior in high-temperature halogen gas corrosion resistance as compared with Ni-based alloys 12 to 26 of the present invention, because the particle generation rates thereof were high.

Furthermore, it was found from the results shown in Tables 4 and 6 that Ni-based alloys 12 to 26 of the present invention were superior in hot forgeability as compared with Conventional Ni-based alloy 3 that is a conventional material. Conventional Ni-based alloy 3 did not reach the evaluation test for high-temperature oxidation resistance because cracks were generated during the hot forging. Also, it turned out that Ni-based alloys 12 to 26 of the present invention exceled in high-temperature halogen as corrosion resistance as compared with Conventional Ni-based alloy 4 that is a conventional material.

It was found from the results of Tables 4 to 6 mentioned above that the Ni-based alloys of the present invention were superior in hot forgeability and were superior in high-temperature oxidation resistance and high-temperature halogen gas corrosion resistance, especially because alloy components B and Zr were simultaneously added in predetermined amounts, respectively.

INDUSTRIAL APPLICABILITY

Because the Ni-based alloy of the present invention is superior in hot forgeability, and also is superior in high-temperature oxidation resistance and high-temperature halogen gas corrosion resistance, it is suitable for use as members that constitute a baking tray for chip capacitor, a baking tray for lithium battery cathode material, a CVD apparatus member, a PVD apparatus member, an LCD apparatus member, and a semiconductor manufacturing apparatus member. Furthermore, in addition to this, it is possible for the Ni-based alloy to be applied as constitutional members of various applications that require high-temperature oxidation resistance and hot forgeability, such as a member for oxidation furnaces, a member for baking furnaces, a muffler in a silver-tin baking process, jigs for processes for fabricating hard metals, and retorts for a baking process of special power (LED raw material etc.) among plates, tube materials, wire materials, cast steels, forged steels of the Ni-based alloys, and jigs and members formed therefrom by processing.

The invention claimed is:

1. A Ni-based alloy suitable for hot forgeability, high-temperature oxidation resistance, and high-temperature halogen gas corrosion resistance, the Ni-based alloy having a composition consisting of, by weight, 2.0 to 5.0% Al,
0.1 to 2.5% Si,
0.1 to 1.5% Mn,
0.001 to 0.01% B,
0.001 to 0.1% Zr,
optionally 0.8 to 4.0% Cr, and
the balance of Ni with inevitable impurities.

2. The Ni-based alloy suitable for hot forgeability, high-temperature oxidation resistance, and high-temperature halogen gas corrosion resistance according to claim 1, the Ni-based alloy having a composition consisting of, by weight, 3.6 to 4.2% Al,
1.1 to 1.7% Si,
0.2 to 0.7% Mn,
0.001 to 0.007% B,
0.001 to 0.06% Zr,
optionally 1.6 to 2.3% Cr, and
the balance of Ni with inevitable impurities.

3. The Ni-based alloy suitable for hot forgeability, high-temperature oxidation resistance, and high-temperature halogen gas corrosion resistance according to claim 1, wherein chromium is present at 0.8 to 4.0% by weight.

4. The Ni-based alloy suitable for hot forgeability, high-temperature oxidation resistance, and high-temperature halogen gas corrosion resistance according to claim 2, wherein chromium is present at 1.6 to 2.3% by weight.

5. A member made of the Ni-based alloy according to claim 1, wherein the member is a baking tray for chip capacitor or lithium battery cathode material, a CVD apparatus member, a PVD apparatus member, an LCD apparatus member, or a semiconductor manufacturing apparatus member.

6. A member made of the Ni-based alloy according to claim 3, wherein the member is a baking tray for chip capacitor or lithium battery cathode material, a CVD apparatus member, a PVD apparatus member, an LCD apparatus member, or a semiconductor manufacturing apparatus member.

* * * * *